US006699034B2

(12) United States Patent
Schoeck

(10) Patent No.: US 6,699,034 B2
(45) Date of Patent: Mar. 2, 2004

(54) KNIT CANDLE WICKS AND METHODS OF MAKING THE SAME

(76) Inventor: Vincent E. Schoeck, 18814 Fountain Ter., Hagerstown, MD (US) 21742

( * ) Notice: Subject to any disclaimer, the term of this patent is extended or adjusted under 35 U.S.C. 154(b) by 0 days.

(21) Appl. No.: 10/131,496

(22) Filed: Apr. 25, 2002

(65) Prior Publication Data

US 2003/0013060 A1 Jan. 16, 2003

Related U.S. Application Data

(60) Provisional application No. 60/287,408, filed on May 1, 2001.

(51) Int. Cl.[7] ..... F23D 3/16; F23D 3/18

(52) U.S. Cl. ..... 431/288; 431/298; 431/325

(58) Field of Search ..... 431/288, 298, 431/325

(56) References Cited

U.S. PATENT DOCUMENTS

| | | | | |
|---|---|---|---|---|
| 21,890 A | * | 10/1858 | Leslie | 431/298 |
| 31,045 A | * | 1/1861 | Weeden | 431/298 |
| 2,074,693 A | * | 3/1937 | Hooper | 139/388 |
| 2,091,528 A | | 9/1937 | Schreyer | |
| 2,316,060 A | | 4/1943 | Fullerton et al. | |
| 3,452,639 A | | 7/1969 | Passman | |
| 3,907,487 A | | 9/1975 | Reiher | 425/517 |
| 4,126,408 A | * | 11/1978 | Cox | 431/2 |
| 4,386,904 A | * | 6/1983 | Miyahara et al. | 431/126 |
| 4,416,616 A | | 11/1983 | Shimizu et al. | 431/325 |
| 4,497,187 A | | 2/1985 | Yamaguchi | 66/87 |
| 5,785,513 A | | 7/1998 | Kiefer et al. | 431/320 |

FOREIGN PATENT DOCUMENTS

| | | | | |
|---|---|---|---|---|
| DE | 19958281 A1 | * | 6/2001 | D06B/3/06 |
| JP | 2000328090 | * | 11/2000 | C11C/5/00 |

OTHER PUBLICATIONS

Wicking, Function and Structure; Atkins & Pearce Manufacturing Company.

* cited by examiner

*Primary Examiner*—Alfred Basichas
(74) *Attorney, Agent, or Firm*—Nixon & Vanderhye PC

(57) ABSTRACT

Knit candle wicks provide a stable, higher yield yet similar burn rate or flame height as compared to lower yield braided candle wicks by providing improved capillary flow as well as an increase in the functional surface area. In addition, candle burning safety is improved as the wicks of this invention provide a self-trimming wick that creates a more stable flame height and uniform wax pool diameter as the candle burns. In preferred forms, the knit wicks of this invention are a warp knit construction in which the interlocking loops run lengthwise in the direction of the wick material. In addition, the various warp knit constructions can comprise both interlocking loop or warp ends as well as weft or laid-in yarns. The wicks of the present invention thus advantageously provide for a stable wick construction that meets the performance and process requirements desired of wicks generally, including flame height, stable wax pool, uniform diameter wax pool, is self-trimming and/or self-supporting, while at the same time providing a higher yield wick with improved capillary flow and enhanced safety features when compared to conventional candle wick constructions.

49 Claims, 4 Drawing Sheets

KNIT CANDLE WICKS AND METHODS OF MAKING THE SAME

CROSS-REFERENCE TO RELATED APPLICATION

This application is based on, and claims domestic priority benefits under 35 USC §119(e) from, U.S. Provisional Patent Application Ser. No. 60/287,408 filed on May 1, 2001, the entire content of which is expressly incorporated hereinto by reference.

FIELD OF THE INVENTION

The present invention relates generally to candle wicks and methods of making the same. More specifically, the present invention relates to candle wicks of knit construction which may be satisfactorily used in candles due to their high yield combined with improved capillary flow and increased functional surface area. In addition, the present invention enhances product safety by providing an improved self-trimming wick capable of maintaining a substantially uniform and stable wax pool and burn rate.

BACKGROUND AND SUMMARY OF THE INVENTION

Candles employing a wick have been in existence for many centuries. A typical candle has a single wick, or multitude of wicks, that extends longitudinally through the body of the candle. Single wicks are usually centrally disposed in the candle body. The combustible candle body is typically a thermoplastic blend of petroleum (paraffin) wax, mineral (montan) wax, synthetic wax (polyethylene or Fischer Tropsch) or natural waxes (vegetable or animal). Clear candle waxes, known as gel candles, have gained recent popularity due to there diverse decorating potential. These gel candles are made from mineral oil and special resins. Natural, plant based soybean wax is gaining popularity as a cost competitive, environmental or "green" wax derived from renewable resources. Various additives used to modify the candle hardness, color, burn rate and aroma are well know in the trade and include, for example, stearic acid, UV inhibitors, polyethylene, scent oils and color pigments.

Upon lighting a candle wick, the heat melts the wax which then travels up the wick by capillary action and is vaporized. Performance requirements of a wick in a candle include the ability to create and maintain the desired burn rate, the ability to create and maintain the desired wax pool and, if specified or required, the ability to bend or curl to maintain the proper wick height (referred to in the trade as "self-trimming"). In addition to these performance requirements, it is important that the finished wick be stable and not subject to size fluctuation when tension is applied to the wick during the candle making or wick pre-waxing process. The ability of the wick to be self-supporting may be preferred, or even required, in certain candle types or candle manufacturing processes.

Burn rate and flame height is influenced by the capillary flow rate, capillary flow volume and/or functional surface area of the wick. Capillary flow rate or the rate of fuel delivery is controlled by the size of capillaries available in a given wick. The size of capillaries is the distance between materials that are creating capillaries. The material that creates capillaries is the individual fibers or filaments within a wick. The distance between, or force applied to, these fibers or filaments determines the size of the capillaries. Therefore, the size of the capillaries is primarily dependent upon the stitch/pick tightness or density of the wick. It is known in the trade that increasing wick density or stitch tightness will reduce the flame height or burn rate. This is due to the fact that tighter stitches reduce the size of the capillaries, thereby restricting or reducing the capillary flow rate. Conversely, reducing the wick density or stitch tightness will increase the flame height or burn rate by increasing the size of the capillaries thereby increasing the capillary flow rate. Capillary flow volume is controlled by the number of capillaries within a wick. The number of capillaries is the amount of surface area within a wick that provides for capillary action. Given the same wick size and density, fiber or filament size controls the number of capillaries or surface area available for capillary action. Thus, the smaller the fiber or filament diameter within a wick, the more capillaries and the greater the capillary flow volume and vice versa.

Functional surface area is the amount of the surface area exposed to temperatures which are sufficiently high to cause vaporization. Wick size (diameter or width) as well as surface contour, will influence the functional surface area of the wick. For example, assuming a constant capillary flow rate, increasing the wick width or diameter will increase not only the capillary flow volume but also the functional surface area and thus increase the flame height or burn rate. Furthermore, the same size and density wick with an undulated exterior surface (i.e., a surface having distinct peaks and valleys) will exhibit a greater functional surface area and, assuming a sufficient capillary flow rate, will produce a higher burn rate and flame height as compared to the same wick with a relatively smooth exterior surface contour.

The ability of the wick to bend or curl is typically preferred and in certain candle types (i.e. tapered or stick) may even be required. The wick curl causes the end of the wick to lean out to the lateral edge of the flame where higher temperatures burn it away. As a result of the wick burning at its terminal end, it becomes self-trimming. Without a self-trimming feature, a wick will quickly become too long, producing a large flame that emits excessive soot while burning as well as producing a large carbon head at the tip of the wick. Wicks that do not curl must be trimmed frequently to maintain the proper flame height or burn rate and wax pool diameter. Conversely, it is important that a wick does not over-curl or bend to the point were the terminal end touches the wax pool. This will either extinguish the candle or cause an excessive flame height and burn rate. In addition, it is important that the wick, once it bends to the outside of the flame, does not continue to curl and create a spiral curl. A wick that curls to, and remains at, the outside edge of the flame and thus becomes self-trimming is typically preferred and in certain candles may even be required for proper, safe performance.

The wick must also create the desired wax pool. The size of the wax pool is related to the flame height or burn rate. The smaller the flame height or burn rate the smaller the wax pool. Conversely, the larger the flame height or burn rate the larger the wax pool. If the wax pool is too small for the candle, the candle will develop a tunnel down the middle of the wick as the heat from the flame is not able to melt the wax at the outer portion of the candle. If the wax pool is too large for the candle, the wax will run excessively over the edges of the candle. In addition, with regard to self-trimming wicks (i.e. wicks whose terminal end curls to the outside of the flame), the wax pool should obtain a desired maximum diameter and then maintain the desired maximum diameter as the candle burns (i.e. so as to create a stable wax pool). Equally important as self-trimming wicks achieving a stable wax pool, certain candles will require a uniform diameter wax pool. If the wax pool created by the heat of the flame is uneven or oblong in shape, the candle may burn down unevenly and in many instances will cause the melted wax to drip or run-off one side of the candle.

It is important that the finished wick material be stable so that its consistency does not change during the candle making or wick waxing process. The finished wick most preferably should have minimal stretch under load. If the wick diameter changes significantly under load (i.e. has excessive stretch or elongation), then the size of the capillaries as well as the functional surface area will change depending on the amount of tension applied to the wick during the candle making or wick waxing process. Generally speaking, the tighter the stitches the more dense the wick and thus the less stretch or more stable the finished wick. However, as noted above, the more dense a given wick is made, the smaller the capillaries and thus the lower the burn rate. It is important for wicks to be designed and manufactured with minimal stretch (i.e. high stability and consistency) while taking care not to create such small capillaries such that the burn rate is inadequate for the candle design. A wick structure or design that maximizes the size of the capillaries yet remains stable during the candle making or wick waxing process is desired.

Certain candles and/or candle making processes may require that the wick be self-supporting during the manufacturing and/or burning process. For example, a self-supporting wick is typically required when manufacturing container candles. Thus, during the manufacture of container candles, the wick is usually tabbed and placed in the bottom of the container with the top of the wick placed in a centering device at the top of the container. Such a wick must be self-supporting when the melted wax is poured into the container. If the wick is not self-supporting, it will fall over or bend when the melted wax is poured into the container. Furthermore, certain candles develop large and deep wax pools when burning. As such, the wick most preferably is self-supporting so as to prevent the wick from falling into the melted wax pool.

Candle wicks have been braided for well over the last century. Such conventional wicks are braided from multiple fiber or filamentary yarns. The most commonly used yarn is cotton although other natural fibers such as rayon have also been employed. Braiding is the intertwining of three or more strands to make a cord or narrow textile band. The strands form a regular diagonal pattern down the length of the cord. The interlaced yarns run diagonally to the production axis of the material. Braided wicks are produced in various sizes, shapes and constructions to achieve the necessary performance (flame height, wax pool size, self-trimming) and process (stability, self-supporting) requirements. Historically, wick manufacturers have offered two groups of braided wicks. One group is self-trimming wicks (i.e. wicks that curl or bend to the outside of the flame) and the other group is self-supporting wicks. Self-trimming braided wicks typically have a flat profile and may be treated with flame retardants to assist wick curl and/or minimize after-glow. Self-supporting braided wicks (also known as "cored wicks") are typically round in profile and have either a paper, cotton or wire material in the core of the braid. This core material in the braided construction creates a self-supporting wick as described above.

As will be evident from the following discussion, there is a need among candle manufacturers for candle wicks capable of overcoming the limitations of conventional braided candle wicks. These performance and process limitations of the braided construction, as outlined below, are know by those skilled in the art of candle making.

One such performance limitation is that braided wick structures do not provide enough capillary flow to optimize the performance in many of today's candles. Specifically, an improved wick is needed for the higher viscose natural waxes such as vegetable or soybean waxes as well as the newer gel waxes. When manufacturing a braided wick, it is well known by those skilled in the trade that increasing the picks per inch will increase the density of the wick (i.e. reduce the yield) and thereby reduce the size of capillaries, thus reducing the potential flame height or burn rate. Conversely, reducing the picks per inch will open the braid and reduce the density of the wick (i.e. increase the yield) and thereby increase the size of capillaries, thus optimizing the flame height or burn rate. However, such an increase in yield and burn rate from conventional braided candle wicks is limited by the fact that creating a more open structure with large capillaries creates a less stable wick which will change in characteristics when subjected to the tensions of the candle manufacturing or wick pre-waxing process. In addition, the smooth surface of a braid reduces the functional surface area. The small capillaries and smooth functional surface area of the braided wick make it more difficult to create the required capillary flow rate in today's natural and gel waxes as well as candles that have high amounts of additives (i.e. scents, dyes) that tend to impede capillary flow.

A further limitation of braided wick technology relates to the uniformity of the wax pool diameter. For example, conventional self-trimming braided wicks will produce an oblong wax pool. The oblong wax pool is the result of the wick curling in one direction and maintaining this fixed directional curl. The fixed directional curl causes the flame to lean in the direction of the flame, thus causing the wax pool to become permanently oblong in shape. This creates a problem in candles where the candle diameter is less than, or substantially equal to, the potential pool diameter (i.e. taper or stick candles), causing the candle to burn down unevenly and allowing the wax to drip or run-off one side of the candle.

It is also known by those skilled in the art of candle making that flat braided, self-trimming wicks may curl to the point where the terminal end bends into the wax pool or continues to curl into a pigtail shape (i.e. a spiral curl). This undesirable result can cause a self-trimming braided wick to increase in length so as to increase the amount of wick material, or functional surface area, above the melted wax pool. This in turn produces, over the length of a burn, a continually increasing (i.e. unstable) flame height and wax pool.

In summary, a higher yield, stable wick construction that improves the capillary flow and functional surface area would offer performance benefits desired by today's candle makers. In addition, the ability of a self-trimming wick to provide a more stable and uniform diameter wax pool as the candle burns would improve candle safety.

Broadly, the present invention is embodied in knit candle wicks. In especially preferred forms, the present invention is embodied in knit candle wicks that provide a higher yield, improved capillary flow as well as an increase in the functional surface area. In addition, the self-trimming wicks of this invention are capable of creating a more stable and uniform wax pool diameter. Most preferably the knit wicks of this invention are a warp knit construction in which the interlocking loops run lengthwise in the direction of the material. In addition, the various warp knit constructions of this invention comprise both interlocking loop or warp ends as well as weft or laid-in yarns typically referred to as warp knitting with weft insertion. The present invention thus advantageously provides for a high yield, stable wick construction that improves candle safety and performance.

These and other aspects and advantages will become more apparent after careful consideration is given to the following detailed description of the preferred exemplary embodiments thereof.

BRIEF DESCRIPTION OF THE ACCOMPANYING DRAWINGS

Reference will hereinafter be made to the accompanying drawings, wherein like reference numerals throughout the various FIGURES denote like structural elements, and wherein.

Figure 4:
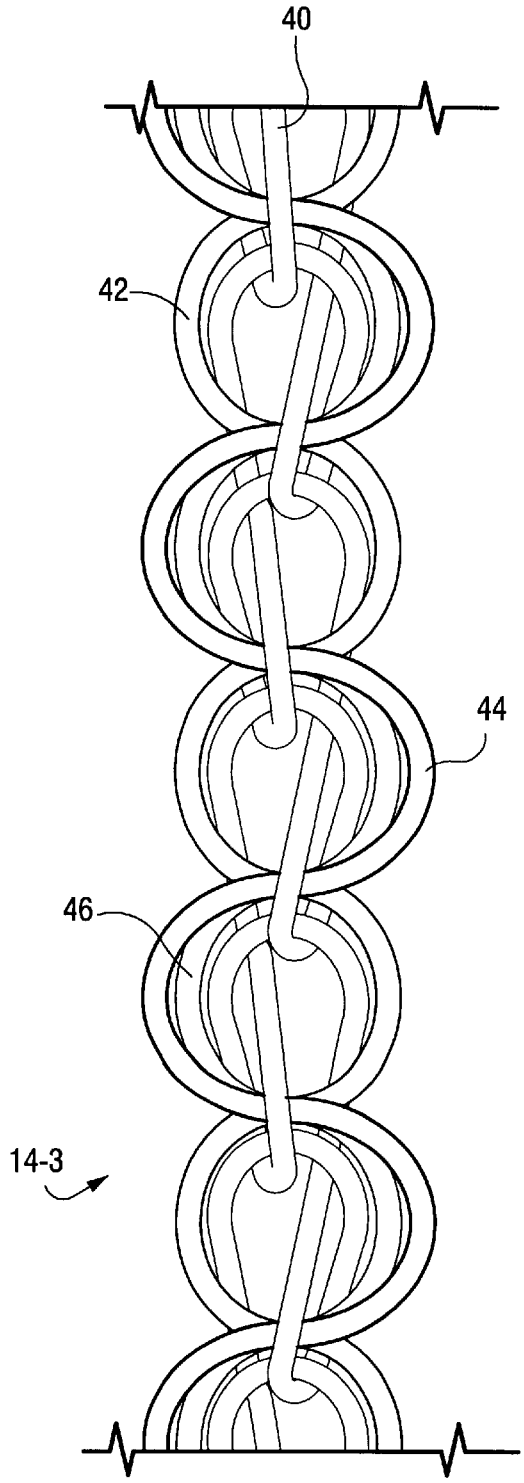
Figure 3:
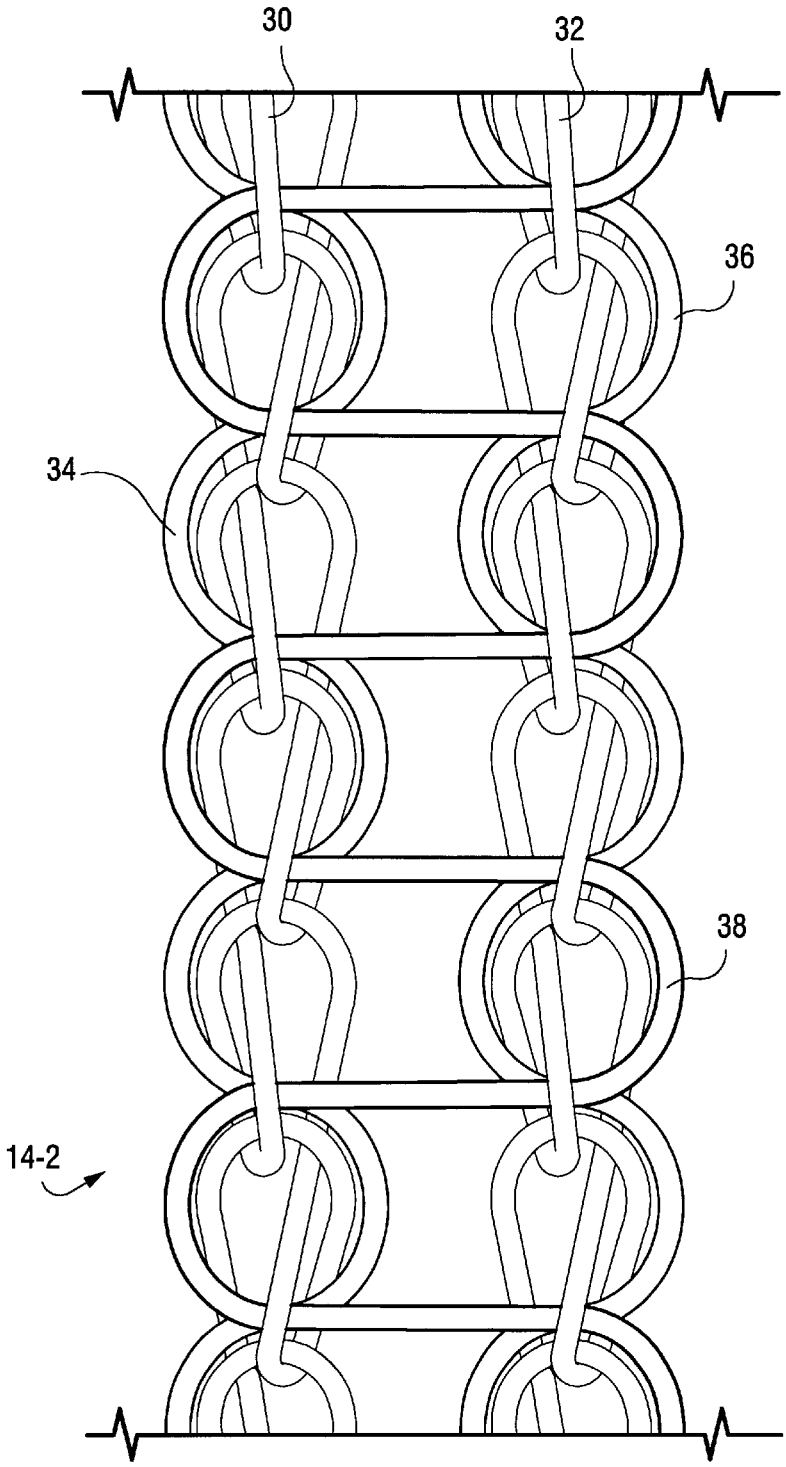
FIG. 3 is a greatly enlarged schematic view of another embodiment of a knit candle wick embodying the present invention having a generally flat cross-sectional shape and which depicts the knit construction in a greatly exaggerated open manner for the purpose of visual clarity.
Figure 3A:
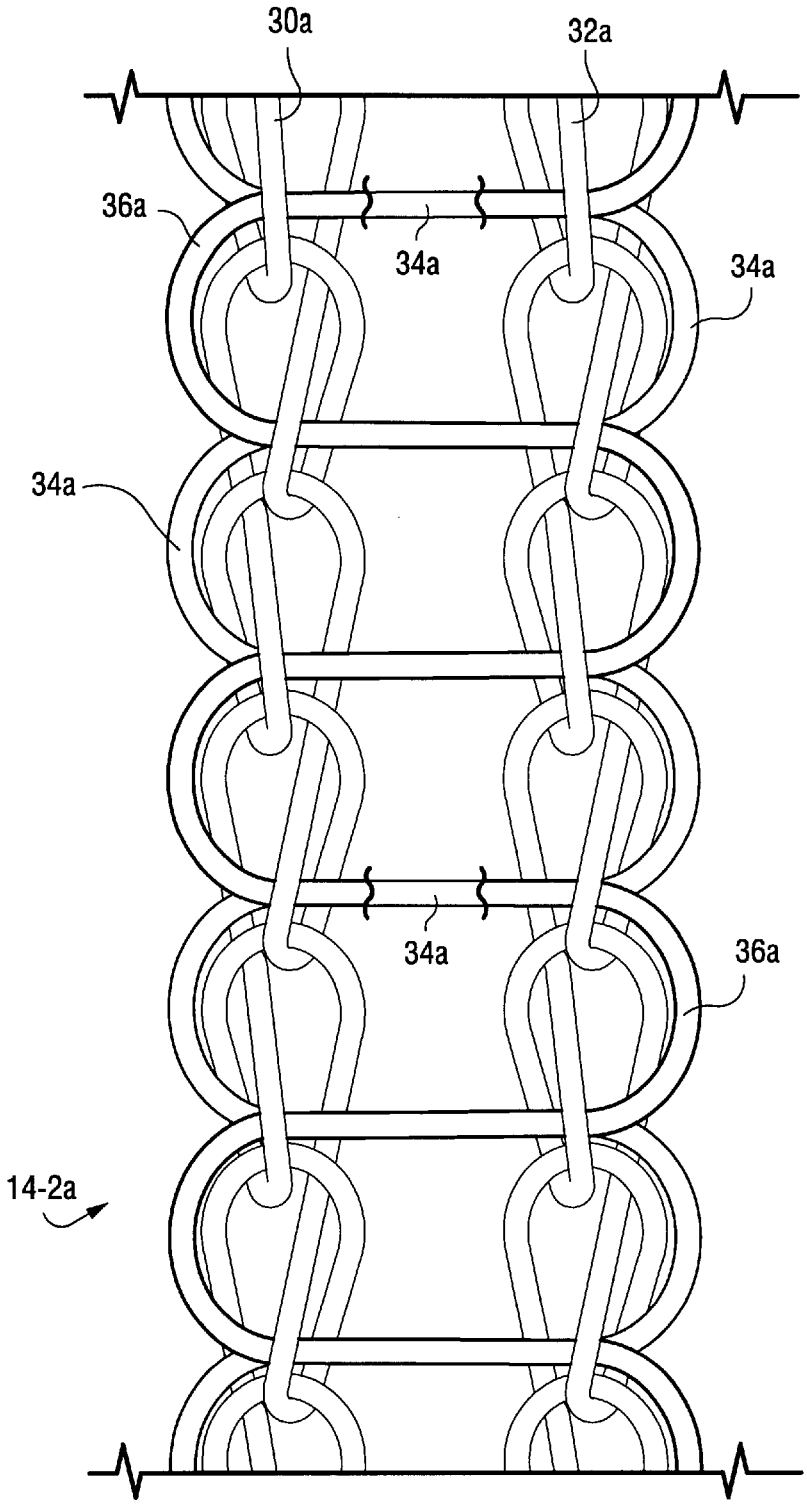

FIG. 3A is a greatly enlarged schematic view of another embodiment of a knit candle wick embodying the present invention similar to the wick depicted in FIG. 3, but having oppositely oriented laid-in yarns joining the wales; and FIG. 4 is a greatly enlarged schematic view of yet another embodiment of a knit candle wick embodying the present invention having a generally square cross-sectional shape and which depicts the knit construction in a greatly exaggerated open manner for the purpose of visual clarity.

DETAILED DESCRIPTION OF THE INVENTION

A. Definitions

As used herein and in the accompanying claims, the terms below are intended to have the following definitions:

"Filament" means a fibrous strand of extreme or indefinite length.

"Fiber" means a fibrous strand of definite length, such as a staple fiber.

"Yarn" means a collection of numerous filaments or fibers which may or may not be textured, spun, twisted or laid together.

"Knit" or "knitting" refers to the forming of loops of yarn with the aid of thin, pointed needles or shafts. As new loops are formed, they are drawn through those previously shaped. This inter-looping and the continued formation of new loops produces a knit material.

"Braid" or "braided" refers to a relatively narrow textile band or cord formed by plaiting or intertwining three or more strands of yarn diagonally relative to the production axis of the band or cord so as to create a regular diagonal pattern down its length.

"Warp knit" or "warp knitting" refers to a type of knitting in which the warp yarns generally run lengthwise in the knit fabric material.

"Warp yarn" refers to the yarn or yarns that form the interlocking loops and generally run lengthwise in the machine direction of the knit fabric material.

"Warp-wise" and "weft-wise" denote the general orientations of yarns forming the knit fabrics as being generally in the machine direction and cross-machine direction, respectively.

"Laid-in yarn" refers to the yarn or yarns that are laid-in with the warp yarns and do not form interlocking loops such that the warp yarns are knit around such laid-in yarns.

"Capillaries" when used in reference to candle wicks means the space between fibers or filaments that allows for melted candle wax to move or wick due to surface tension between the liquid and the fibers or filaments.

"Capillary flow" refers to the movement of liquid along capillaries.

"Capillary flow rate" refers to the rate of fuel delivery and is determined by the size of capillaries within a wick.

"Capillary flow volume" is the weight of wax that the wick is able to hold after being soaked in melted wax and hung for five minutes expressed as a percentage of the initial dry wick weight.

"Capillary speed" is the time to move a liquid 100 mm up the wick when the wick is hanging in a vertical position.

"Number of capillaries" refers to the amount of surface area within a wick that provides for capillaries.

"Size of capillaries" refers to the distance between materials that are creating the capillaries and is determined by the density or stitches/picks per inch of the finished wick.

"Functional surface area" is the available surface area from which vaporization can take place, i.e. the amount of surface area exposed to temperatures high enough to cause vaporization.

"Burn rate" is the amount of fuel, expressed by weight, consumed over a period of time.

"Wick curl" is the arc from the top of the wax pool to the terminal end of the wick that is formed by the wick after it is burned in the candle, expressed in degrees. Preferably, those wicks of the present invention which exhibit a wick curl will have no more than about 90° of such wick curl (i.e., so that the terminal end of the wick does not extend substantially beyond a horizontal plane relative to a vertical axis of the candle in which the wick is formed).

"Self-trimming" is the regulation of the wick height and length, to an acceptable size so that it burns clean with little carbon build-up or smoking, by the candle burning process. A certain amount of "wick curl" is required for a wick to be "self-trimming".

"Spiral curl" refers to the arcing of a wick during the burning process where the measurement of the arc is greater than 180 degrees relative to the wick axis and the wick begins to turn back toward itself and back into the center of the flame forming a spiral.

"Self-supporting" refers to a property of a wick whereby a finite length of the wick remains generally oriented along the wick's elongate axis when held upright without lateral support.

"Wick torque" means that the curled terminal end portion of the wick twists about a substantially horizontal axis relative to a vertical axis of the candle in which the wick is form, and is expressed in degrees relative to such substantially horizontal axis. Preferably, those wicks of the present invention which exhibit a wick torque will have between about 45 to about 135 degrees of such wick torque.

"Wick rotation" means that the terminal end of the wick curl traces an arc in a generally transverse plane about the elongate axis of the candle as expressed in degrees of rotation relative to a baseline or normal state of the wick's terminal end. In preferred embodiments, those candle wicks of the present invention which exhibit wick rotation will have at least about 45 degrees of such wick rotation per inch of burned candle length, more preferably at least about 90 degrees of wick rotation per inch of burned candle length, and most preferably between about 90 to about 270 degrees of wick rotation per inch of burned candle length.

"Effective diameter" is the diameter, expressed in millimeters (mm), of the smallest circle which entirely contains a cross-sectional area of the wick.

"Minimal stretch" means an amount of stretch or elongation of the finished wick during the candle making or wax application process such that the performance characteristics of the wick are not materially affected. Most preferably, the wicks of the present invention will exhibit minimal stretch characteristics so as to have an axial elongation in wick length of less than about 15%, and preferably less than about 10%, when subjected to a tension force of 2 pounds as compared to an original wick length.

"Stable wax pool" means a wax pool that has attained a maximum diameter which does not increase over time during candle burning.

"Uniform diameter wax pool" refers to a wax pool that has a substantially uniform circular diameter.

B. Description of Preferred Exemplary Embodiments

As noted above, the present invention is embodied in a knit candle wick. Knitting is a method of constructing a relatively narrow fabric or tape by an interlocking series of loops of one or more yarns. Most preferably, the knit candle wicks of the present invention are warp knit fabric structures. Warp knitting is a type of knitting in which the yarns generally run lengthwise in the fabric structure. Examples of warp knitting include tricot, milanese, and raschel knitting. In especially preferred forms, the present invention is embodied in a knit candle wick having an interlocking series of loops running lengthwise in the material with one or more laid-in yarns inserted in the loops.

One advantage of a warp knit candle wick is the ability to produce an open yet stable (i.e. minimal stretch) structure. The formation of loops that run parallel to the direction of the fabric structure provides a high yield, open structure with large capillaries to increase the capillary flow rate. In addition, the open structure, combined with the undulated exterior surface caused by the knit loops, increases the functional surface area and capillary flow volume. Furthermore, the laid-in yarn stabilizes the wick and reduces stretch. The result is a wick structure with increased capillary flow rate due to an increase in the size of the capillaries within the wick as well as a wick with increased capillary flow volume and functional surface area from which vaporization of the wax can take place.

Figure 1:
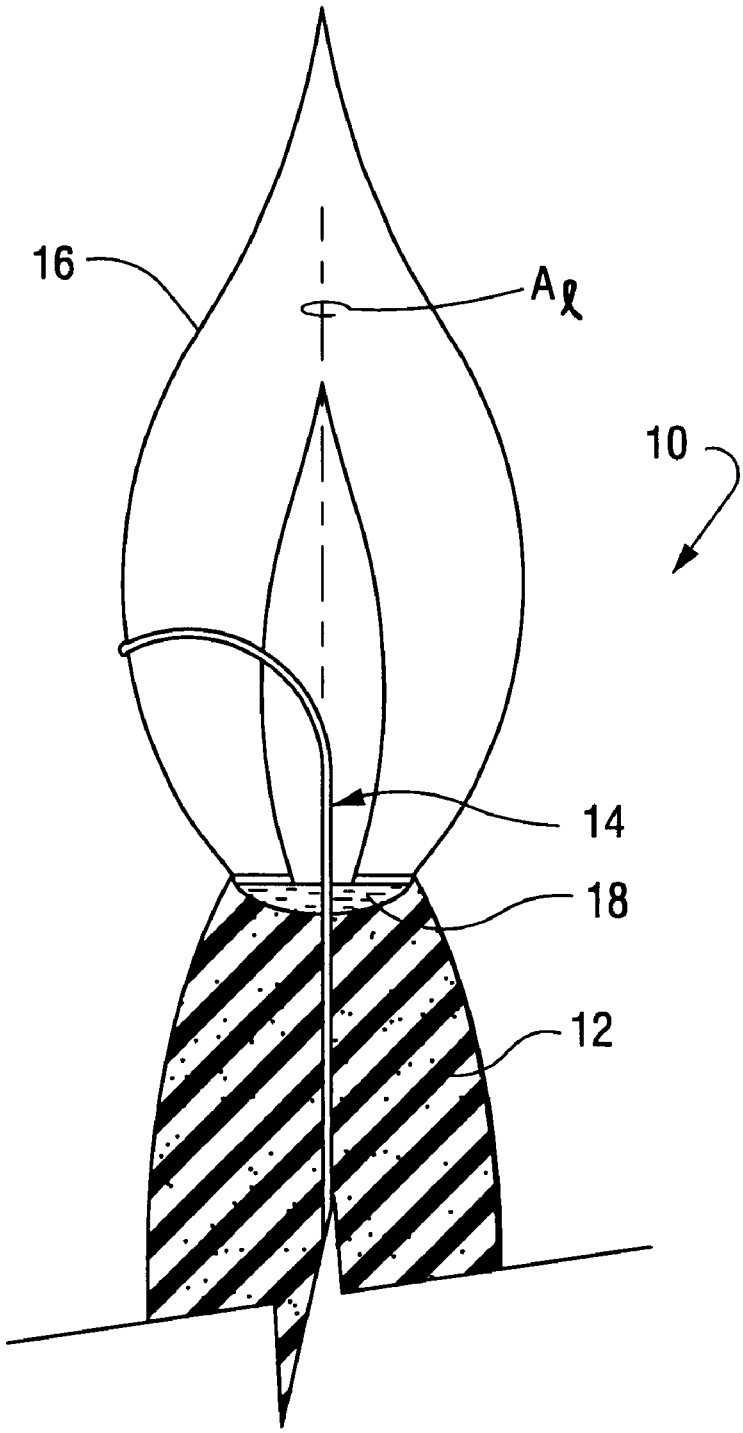
FIG. 1 is a schematic cross-sectional view of a burning candle which embodies a knit candle wick in accordance with the present invention.

Accompanying FIG. 1 depicts an exemplary burning candle 10 which includes a body 12 formed of a solid, combustible candle wax material with a wick 14 in accordance with the present invention embedded therein. In this regard, the elongate (longitudinal) axis $A_l$ of the candle wick 14 substantially coincides with the elongate axis of the candle body 12. The flame 16 burning at the top end of the candle body 12 creates a generally circularly shaped (as viewed from above) molten wax pool 18 which serves as a reservoir of fuel to be supplied by the wick 14 to allow combustion to continue.

As shown in FIG. 1, the wick 14 exhibits wick curl. That is, the terminal end portion of the wick 14 is arced laterally relative to the wick's elongate axis $A_l$ so that a portion thereof extends generally at a right angle (e.g., about 90°) relative to the elongate axis $A_l$. As a result, the terminal end of the wick 14 generally is positioned at the edge of the flame 16 thereby allowing the terminal end portion of the wick 14 itself to be combusted. As can be appreciated, and as was discussed above, such controlled wick curl and wick combustion allows the wick 14 of the present invention to be self-trimming.

Certain candle designs may, however, require a self-supporting wick that is not self-trimming (i.e. does not curl). For example, the container of a container candle may be sufficiently close to the edge of the flame so that wick curl is not desired. This is due to the fact that wick curl may cause the heat from the flame to project close to the edge of the container. In such situations, non-curling attributes may be imparted to the wicks of the present invention. For example, materials such as paper, zinc wire, polyethylene or polypropylene fibers may be inserted into one or more of the warp or weft ends (i.e. laid-in yarns) to prevent the wick from curling. In addition, various tensions can be applied to the warp or laid-in yarns to prevent or enhance wick curl.

Figure 2:
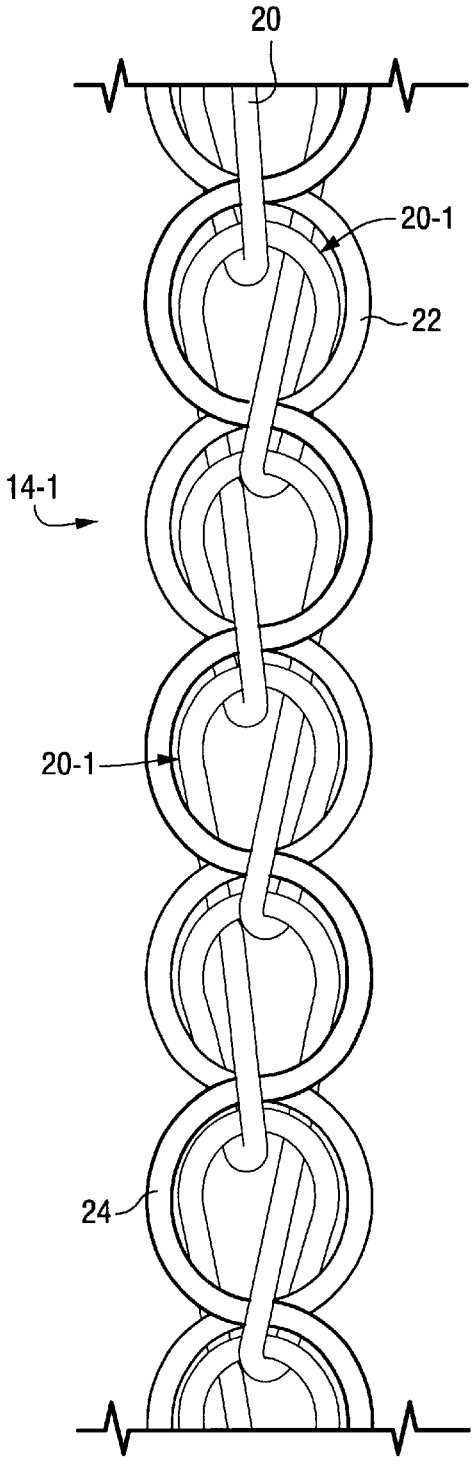
FIG. 2 is a greatly enlarged schematic view of one embodiment of a knit candle wick embodying the present invention having a generally round/oval cross-sectional shape and which depicts the knit construction in a greatly exaggerated open manner for the purpose of visual clarity.

Various sizes and cross-sectional designs can be made using the preferred warp knit construction. For example, accompanying FIG. 2 shows schematically an exemplary warp knit construction so as to achieve an oval or round wick 14-1. In this regard, the warp yarn 20 forms the interlocking loops (a few of which are identified by reference numeral 20-1) which are knit around the laid-in yarns 22 and 24, respectively. The warp and laid-in yarns 20, 22 and 24 are tensioned in such a way to create a stable non-stretch wick. That is, it will be understood that the depiction of all the yarns 20, 22 and 24 (in FIG. 2 and the other drawing FIGS. 3–4 to be discussed below) is schematic and that the laid-in yarns 22 and 24 will actually be laid-in under some tension. Such a construction comprising one warp yarn 20 and two laid-in yarns 22, 24 produces a generally oval or round cross-sectional wick 14-1. The wick size can be increased or decreased by using larger or smaller yarns or combining any number of yarns to form the interlocking loops or warp and weft or laid-in yarns. Those skilled in the art of knitting would understand that one could vary the position or number of laid-in yarns to produce a similar oval or round profile knit candle wick.

Accompanying FIG. 3 schematically depicts a construction of a generally flat profile knit wicks 14-2. In this regard, in order to form a generally flat profile knit wick 14-2, two separate warp yarns 30, 32 are knit so as to form parallel side-by-side rows of continuous interlocking loop yarns colloquially known as wales in the art. Each such wale formed by the warp yarns 30, 32 is knit around a corresponding laid-in yarn 34, 36, respectively. In addition, the two wales 30, 32 are combined to form a single flat knit wick 14-2 by means of another laid-in or weft-inserted yarn 38. As show, this additional laid-in yarn 38 extends alternately from one loop in one of the wales to another loop in the other of the wales in generally a back-and-forth weftwise meandering pattern. Each yarn is tensioned is such a way to create a stable non-stretch wick. The width and/or thickness can be increased or decreased by using larger or smaller yarns or combining any number of yarns to form the two wales as well as increasing or decreasing the size or combining yarns that form the weft or laid-in yarns. In addition, the width can be increased by adding additional wales and connecting the wales with additional laid-in yarns, if desired. Those skilled in the art of knitting would understand that one could vary the position or number of laid-in yarns to produce a similar flat profile knit candle wick.

Accompanying FIG. 3A is a wick 14-2*a* similar to the embodiment of wick 14-2 depicted in FIG. 3, but includes oppositely oriented yarns 34*a*, 36*a* which are laid-in, and thus join, the parallel wales 30*a*, 32*a* one to another. The construction of the wick 14-2*a* provides for a substantially flat wick structure due to the warp yarns being knit to form parallel side-by-side wales 30*a*, 32*a* of continuous interlocking loop yarns. The wales 30*a*, 32*a* are combined to form a single flat knit wick 14-2*a* by means of at least two additional laid-in or weft-inserted yarns 34*a*, 36*a* traveling alternately between wales from one loop to another in opposite respective directions. That is, the laid-in yarns 34*a*, 36*a* travel in opposite back-and-forth or meandering patterns relative to one another. Each of the yarns 34*a*, 36*a* is most preferably tensioned in such a way to create a stable wick exhibiting minimal stretch characteristics. The width and/or thickness of the wick 14-2*a* may be increased or decreased by using larger or smaller yarns or by combining any number of yarns to form the two wales 30*a*, 32*a*. In addition, the size or number of yarns that form the weft or laid-in yarns 34*a*, 36*a* may be increased or decreased as may be desired. Those skilled in the art of knitting will realize also that the position and/or number of laid-in yarns could be varied so as to make similar flat profile knit candle wicks.

FIG. 4 shows another exemplary knit construction which forms a generally square or rectangular shaped knit wick 14-3. As with FIGS. 2 and 3, the wick 14-3 will necessarily include a warp yarn 40 which forms a series of interlocking loops. The interlocking loops are knit around the three weft or laid-in yarns 42, 44 and 46, respectively, which give structural dimension to the wick 14-3 in a plane above that of FIG. 3 (that is, give the wick 14-3 greater depth dimension making it generally square or rectangular in cross-section). The warp and laid-in yarns are tensioned in such a way to create a stable non-stretch wick 14-3. Such a construction comprising one warp and three laid-in yarns thereby produces a square or rectangular shaped cross-sectional wick. The wick size can be increased or decreased by using larger yarns or combining any number of yarns to form the interlocking loops or warp and weft or laid-in yarns. Those skilled in the art of knitting would understand that one could vary the position or number of laid-in yarns to produce a similar square of rectangular profile knit candle wick.

As noted previously, the wicks of the present invention are stable knit fabric structures. That is, the wicks of the present invention exhibit minimal stretch characteristics when tensioned along their elongate axis $A_l$. Most preferably, the wicks of the present invention will exhibit minimal stretch characteristics so as to have an axial elongation in wick length of less than about 15%, and preferably less than about 10%, when subjected to a tension force of 2 pounds as compared to an original wick length. Although a variety of wick sizes can be made employing the present invention, the wicks will typically have an effective diameter of between about 0.25 mm to about 15 mm.

As will become evident with the following examples, a candle wick manufactured from a series of interlocking loops, rather than a similar size braided wick constructed from interlaced yarns, will produce a higher yield product due to its more open, yet stable, structure. Such wicks are capable of producing burn rates similar to lower yield braided wicks. Although the knit construction will have less material per linear length of wick, it produces a similar burn rate to a braided construction containing more material per linear length of wick. The stable yet open candle wick structure of the present invention creates a wick with improved capillary flow as well as a wick with increased functional surface area.

Wick curl, and the amount of wick curl is influenced by the cross-sectional profile of the wick, position of the weft or laid-in yarns, yarn tensions, type of materials used and/or chemical treatment of the wick. For example, a knit candle wick with a flat profile will typically curl more than one with a round or rectangular profile. In addition, the more weft-wise the direction of the laid-in yarns in the finished wick, the faster a wick will curl and the amount of wick curl will increase. In addition, warp tensions higher than weft tensions will retard the wick curl. Conversely, warp tensions lower than weft tensions will cause the knit candle wick to curl.

Furthermore, the wicks of the present invention can be designed not to spiral curl. For example, with regard to the present invention, if the laid-in yarn 34 in the warp ends 30 in FIG. 3 is tensioned higher than the laid-in yarn 36 in the other warp end 32, the wick 14-2, as it curls, will also torque or twist along the horizontal axis of the bent or curled wick. In addition, using unbalanced yarns will also cause the knit wick to torque or twist along the horizontal axis. Most preferably the wicks of the present invention will exhibit a wick torque of at least about 45°. This wick torque or twisting action prevents the curled terminal end portion of the wick, as it burns, from over curling or bending to the point were the wick terminal end portion dips back into the wax pool. In addition, the wick torque or twisting action prevents the formation of a spiral curl.

As discussed above, the formation of a spiral curl creates an unstable flame height and wax pool. By eliminating the possibility of excessive curl or spiral curl, the wicks of the present invention create a safer wick by maintaining the functional surface area of the wick above the wax pool and thus create a stable flame height and wax pool during the candle burn. In addition to reducing the potential for spiral curl and thus creating a more stable wax pool, the wick torque or twisting action causes the curled terminal end portion of the wick, as it burns, to slowly rotate about the elongate axis of the candle so that the wick's terminal end portion evolves around the complete circumference of the candle thereby maintaining a uniform size wax pool and thus preventing the melted wax from dripping or running off one side of the candle. This is particularly important were the potential melted wax pool is at least as large as the candle diameter (i.e. taper or stick candles). The wicks of the present invention, by providing a more stable wax pool as well as a more uniform diameter wax pool, therefore contribute to improved candle safety.

Any technique that is employed to impart self-supporting techniques to conventional braided wicks may be employed for a similar purpose in the knit wicks of the present invention. Some examples of such techniques include incorporating a combustible substance (wire, paper, cellulose acetate, polyethylene, polypropylene etc.) or a coating (polyacrylate, polyalkylacrylate etc.) that has a higher melt point than the melted candle wax and will thus remain self-supporting in the candle while it is burning or during the candle making process.

Additional processes may be required to improve the visual appearance or performance of this invention. These additional processes are well known in the art and include bleaching of the cotton yarn, applying chemistry to the material to prevent embers from continuing to burn at the end of an extinguished wick and wax coating or impregnation of the wick. Suffice it to say, that virtually any technique employed to impart desired structural and/or functional attributes to conventional braided wicks may also be employed in the knit wicks of the present invention.

The present invention will be further understood after consideration is given to the following non-limiting examples:

EXAMPLE 1

A warp knit wick WK1 having the knit structure as shown generally in accompanying FIG. 3 was made from five (5) ends of 10/1 Cherokee cotton yarn supplied from Wehadkee Yarn Mills, West Point Ga. with the finished candle wick having 12.4 stitches per inch. The two wales were each comprised of a 10/1 cotton yarn. Each warp end is knit around one end of the laid-in yarn which is also a 10/1 cotton yarn. The two wales are knit around an additional laid-in yarn that holds the two warp ends together. Warp knit wick WK2 was made from a single warp yarn that comprises two ends of 20/2 Cherokee cotton yarn supplied from Wehadkee Yarn Mills, West Point Ga. to form a knit structure with 12.4 stitches per inch generally as shown in accompanying FIG. 2. The warp-wise loops are knit around two 20/2 laid-in yarns.

The capillary flow rate is the time required to wick 100 mm of lamp oil (Lamplight Farms, Menomonee Falls, Wis. lamp oil) up the finished wick. Capillary flow volume represents the amount of said lamp oil the wick is capable of holding after being submerged in above lamp oil and allowed to hang for 5 minutes. To determine the burn rate (gr./hr.) each sample was lit and allowed to burn for 4 hours. Wicks were not trimmed during the 4 hr. burn time.

The warp knit wicks WK1 and WK2 and braided wicks B1 and B2 of similar size. were examined to determine their respective burn rate, capillary flow rate and capillary flow volume. Data in Table 1A below represents the average of 5 readings of each sample. The data appear in Tables 1A and 1B below.

TABLE 1A

| Wick Type | Profile | Width/Diameter (in.) | Burn Rate (gm/hr) | Pool Dia. (inches) | Yield (yds/lb) | % Yield Increase |
|---|---|---|---|---|---|---|
| WK1 | Flat | 0.10 | 6.31 | 2.500 | 733 | 49.0 |
| B1 | Flat | 0.10 | 6.34 | 2.300 | 490 | — |
| WK2 | Round | 0.075 | 6.70 | 1.935 | 857 | 100.7 |
| B2 | Round | 0.075 | 6.65 | 1.930 | 427 | — |

TABLE 1B

| Wick Type | Profile | Width/Diameter (in.) | Capillary Speed (secs) | Initial Wt. (gms/3-ft) | Soaked Wt. (gms) | Capillary Volume (gms) |
|---|---|---|---|---|---|---|
| WK1 | Flat | 0.10 | 196.00 | 0.660 | 2.310 | 1.650 |
| B1 | Flat | 0.10 | 333.00 | 0.771 | 2.143 | 1.172 |
| WK2 | Round | 0.075 | 204.00 | 0.550 | 1.745 | 1.194 |
| B2 | Round | 0.075 | 265.00 | 1.122 | 2.646 | 1.524 |

As shown in the data of Table 1A, the knit constructions of WK1 and WK2 offer a 49% and 100.7% increase in yield, respectively, as compared to the conventional braided wicks B1 and B2 of similar size. The increase in yield is due to a more open structure that the warp knit provides which in turn allows for a more efficient capillary flow rate. More specifically, although the wick of WK1 has 33% less material per linear length than the braid sample B1, it has a significantly faster capillary speed combined with a higher capillary volume. Similarly, the warp knit sample WK2 has 50% less material per length than the braid sample B2 yet has a 23% faster capillary speed and only a 21% reduction in capillary volume. The fact that the knit sample WK2 has a similar burn rate as the braided sample B2, yet has less capillary volume is due to the higher functional surface area of the knit construction. That is, since both wicks are supplying wax at a greater rate than is being vaporized, it can be concluded that the functional surface area is controlling the burn rate.

EXAMPLE 2

Several warp knit wicks WK3 through WK5 were made and examined with additional samples of WK1 (referred to as WK1A) so as to determine the effect of stitch or wale density (expressed as stitches per inch) on capillary flow rate. Each sample was manufactured as described in Example 1 with the exception of stitches per inch. Data in Table 2 below represents the average of 5 readings of each sample. The data appears below in Table 2.

TABLE 2

| Wick Type | Stitches/In. | Profile | Width/Dia.(in.) | Capillary Speed (secs) |
|---|---|---|---|---|
| WK1A | 12.4 | Flat | 0.10 | 188 |
| WK3 | 15 | Flat | 0.10 | 195 |
| WK4 | 15.8 | Flat | 0.10 | 217 |
| WK5 | 16.9 | Flat | 0.10 | 228 |

As shown in the data of Table 2 above, the tighter the stitches (less open structure), the slower the capillary speed.

EXAMPLE 3

A warp knit wick WK6 having the knit structure as shown generally in accompanying FIG. 3 was made from five (5) ends of 10/1 Shufford Mills sky grade cotton, Hickory N.C., with the finished product having 17 stitches per inch. The two wales were each comprised of a 10/1 cotton yarn. Each warp end is knit around one end of the laid-in yarn which is also a 10/1 cotton yarn. The two wales are knit around an additional laid-in yarn that holds the two warp ends together. During the 4 hour burn test the wicks were trimmed hourly to ¼" height above the wax pool.

The warp knit wick WK6 and braided wicks B3 of similar size were examined to determine their respective burn rate relative to yield. The data appear in Table 3 below.

TABLE 3

| Wick Type | Profile | Surface Area | Yield (yds/lb) | Wt./Yard (lbs.) | % Yield Increase | Burn Rate (gm/hr) |
|---|---|---|---|---|---|---|
| WK6 | Flat | 0.254 | 722 | 0.001385 | 12.80 | 6.71 |
| B3 | Flat | 0.262 | 646 | 0.001548 | | 6.55 |

As shown in the data of Table 3, the knit constructions of WK6 offers a 12.80% increase in yield compared to the conventional braided wick B3. The increase in yield is due to a more open structure (i.e. larger capillaries) that the warp knit provides which in turn allows for a more efficient capillary flow. More specifically, although WK6 has 10.53% less material per linear length than the braided sample B3, WK6 is able to produce a higher burn rate.

EXAMPLE 4

Warp knit wicks WK7 and WK8 were made so as to demonstrate the effect of stitch or wale density (expressed as stitches per inch) on wick elongation. The data appears below in Table 4.

TABLE 4

| Wick Type | Stitches per Inch | Profile | Elongation (2 lb load) |
|---|---|---|---|
| WK7 | 16 | Flat | 8.7 |
| WK8 | 13.5 | Flat | 5.6 |

The data in Table 4 illustrates that stitches per inch of warp knit candle wicks, and specifically flat wicks, may be reduced (to create a more open structure and thus maximize capillary flow rate) without negatively impacting (i.e. increasing) wick elongation. Reducing the stitches per inch of the warp knit construction of this invention, to create a more open structure, actually reduces the elongation (i.e. increases the wick stability).

EXAMPLE 5

Additional samples of WK6 (referred to as WK6A) and similar size braided wick B3 (referred to as B3A) were selected to compare capillary flow volume. Initial weight is the weight of the 40 cm sample prior to being saturated with paraffin. The saturated sample represents the weight of the 40 cm sample after submerging in melted paraffin wax for 30 seconds and hung for 5 minutes to dry. The data appears in Table 5 below.

TABLE 5

| Wick Type | Profile | Surface Area | Yield (yds/lb) | Initial Wt. (40 cm) | Saturated Weight (gr) | Wax Wt (gr.) | Capillary Flow Volume % |
|---|---|---|---|---|---|---|---|
| WK6A | Flat | 0.254 | 722 | 0.271 | 1.248 | 0.977 | 361% |
| B3A | Flat | 0.255 | 646 | 0.312 | 0.984 | 0.672 | 215% |

As shown in the data of Table 5, the knit construction of WK6A has a capillary flow volume of 361% in paraffin compared to the braided construction of B3A with a capillary flow volume of 215% in paraffin. Furthermore, although WK6A has 13.20% less material per linear length, its more open structure (i.e. larger capillaries) and undulated surface allows the wick to hold 45% more total wax (0.977 grams) than the braided B3A wick (0.672 grams).

EXAMPLE 6

Additional samples of WK6 (referred to as WK6B) and similar size braided wick B3 (referred to as B3B) were selected and a four-hour burn rate test was performed to determine the effect of wax viscosity on each wick. Each wick was trimmed hourly to maintain a ¼" wick height above the wax pool. The data appears in Table 6 below.

TABLE 6

| Wick Type | Profile | Surface Area | Yield (yds/lb) | Burn Rate - 4 hr. Paraffin | Burn Rate - 4 hr. Soybean |
|---|---|---|---|---|---|
| WK6B | Flat | 0.254 | 722 | 6.70 | 3.54 |
| B3B | Flat | 0.255 | 646 | 6.65 | 2.44 |

As shown in the data of Table 6, the higher viscosity soybean wax results in a lower burn rate for each wick when compared to the burn rate for each wick in paraffin. However, wick WK6B of this invention had a significantly lower burn rate decline when compared to the burn rate decline of a conventional braided wick structure.

EXAMPLE 7

A warp knit wick WK9 having the knit structure as shown generally in accompanying FIG. 3 was made from five (5) ends of 10/1 Shufford Mills sky grade cotton, Hickory N.C., with the finished product having 17 stitches per inch (i.e. same construction as in Example 3). In addition, distilled water with 1.5% wetting agent was then applied to the finished product which was then heat set under tension.

A 4" wide paraffin pillar candle was made using wick WK9. The wick was trimmed to ¼" prior to lighting and then allowed to burn for 8 hours without additional wick trimming. Burn rate, flame height and pool diameters were measured at 4 and 8 hours. The data appears in Table 7 below.

TABLE 7

| | Burn Rate (gr./hr.) | | Flame Ht. (in.) | | Pool Diam. (in.) | |
|---|---|---|---|---|---|---|
| Wick Type | 4 hr. | 8 hr. | 4 hr. | 8 hr. | 4 hr. | 8 hr. |
| WK9 | 5.7 | 5.6 | 1.25 | 1.25 | 2.125 | 2.125 |

It is known by those skilled in the art of candle making that flat braided wicks tend to curl beyond 90 degrees to either dip back into the wax pool or pig-tail (spiral curl). This undesirable attribute can cause the burn rate, flame height and pool diameter of candles with braided wicks to continue to increase over the candle burn time. By using unbalanced yarn in the warp knit wick of this invention, the wick can be made to also torque (i.e. wick torque) as it curls to the outside edge of the flame. This wick torque or twisting action prevents the wick from curling much beyond 90 degrees so as to prevent the formation of a spiral curl. The result is a wick capable of providing, over time, a consistent burn rate, flame height and wax pool diameter as evident from the data in Table 7 above.

EXAMPLE 8

A warp knit wick WK10 having the knit structure as shown generally in accompanying FIG. 3 was made from five (5) ends of 10/1 Shufford Mills sky grade cotton, Hickory N.C., having 16 TPI (i.e. turns per inch) in the Z direction with the finished product having 19.5 stitches per inch and a twist level of 1.5 TPI (i.e. turns per inch) in the S direction. The finished S twist level can be increased, and thus increase the amount of wick rotation, by using un-balanced yarns having more than 16 TPI. The un-balanced yarns in the warp knit construction cause the finished product to torque or twist when in the relaxed state. For example, using the un-balanced yarns in WK10 resulted in a finished product with 1.5 TPI (referred to as the "natural twist"). The wick is straightened as it is waxed and made into a tapered candle. Upon lighting of the candle, the wick curls to approximately 90 degrees (i.e., to substantially horizontal) and then begins to rotate about the elongated axis of the candle. This rotation is believed to be the result of the wick material, as it burns, wanting to recover to its natural twist state. The amount of rotation can be increased by using more un-balanced yarns (i.e. yarns with greater than 16 TPI) or by mechanically twisting the finished wick in the opposite direction of its natural twist. With regard to WK10, 3 TPI in the Z direction were added to the finished product by the process of wetting, twisting and then drying the warp knit wick (referred to as "mechanical twist") to increase the amount of rotation described above.

A stick candle with a diameter of ⅞" was made using wick WK10 as described above. The candle was thereafter burned so that wick rotation could be examined visually. The data appear below in Table 8.

TABLE 8

| Wick Type | Profile | Surface Area | Total Rotation (degrees) | Rotation Per Inch (degrees) |
|---|---|---|---|---|
| WK10 | Flat | 0.254 | 900 | 150 |

As shown in the data of Table 8 above, as the WK10 wick burns, it also slowly rotates about the elongated (vertical) axis of the candle. This rotation is believed to be the result of the wick material, as it burns, wanting to recover to its natural twist. The total rotation of 900 degrees is the amount of rotation per six (6) inches of candle height burned and the rotation per inch is the average rotation per one (1) inch of candle height burned. As evident from the above data, the wick's terminal end portion revolves around the complete circumference of the candle thereby maintaining a uniform size wax pool (i.e. uniform diameter wax pool) and thus prevents the melted wax from dripping or running off one side of the candle.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A candle wick comprising at least one warp knit yarn end forming a wale of interlocking loops, and at least one unknit laid-in yarn end which is laid in preselected ones of said interlocking loops.

2. A candle wick as in claim 1, wherein said at least one unknit laid-in yarn end is oriented in a warn-wise direction of the wick.

3. A candle wick as in claim 1 or 2, which comprises a second unknit laid-in yarn which is laid in the interlocking loops of said at least one warp knit yarn end differently than said at least one unknit yarn end.

4. A candle wick as in claim 1 or 2, wherein the at least one warp knit yarn end is tensioned differently than said unknit laid-in yarn end.

5. A candle wick as in claim 1 or 2, which comprises at least two differently tensioned unknit laid-in yarns and/or at least two differently tensioned warp knit yarn ends.

6. A candle which includes a candle wick as in claim 1 or 2.

7. A candle which includes a candle wick as in claim 3.

8. A candle which includes a candle wick as in claim 4.

9. A candle which includes a candle wick as in claim 5.

10. A candle wick which comprises a pair of parallel warp yarns knit into loops forming one and another adjacent wales, at least one and another warp-wise unknit laid-in yarns which are laid in the knit loops of said one and another said wales, respectively, and at least one additional unknit laid-in yarn which extends back and forth between the loops of said one and another wales to thereby join said one and another wales together.

11. A candle wick as in claim 1 or 10 which is self-supporting.

12. A candle which includes a candle wick as in claim 10.

13. A candle which includes a candle wick as in claim 11.

14. A candle wick as in claim 10, wherein said at least one additional unknit laid-in yarn has a tension sufficient to impart minimal stretch characteristics to the wick to achieve an axial elongation in wick length of less than about 15% when subjected to a tension force of 2 pounds as compared to an original wick length.

15. A candle wick comprised of at least one pair of knit yarn ends forming adjacent parallel wales, and at least one laid-in yarn which joins said parallel wales one to another.

16. A candle wick as in claim 15, which comprises a pair of oppositely oriented laid-in yarns joining said parallel wales one to another.

17. A candle wick as in claim 15, wherein at least one of said wales includes a laid-in yarn.

18. A candle wick as in claim 15, wherein each of said wales includes a laid-in yarn.

19. A candle wick as in claim 18, wherein each said laid-in yarn has a tension that is at least substantially equal to or greater than the tension of said wales.

20. A candle wick as in claim 15, wherein at least one of said wales has a different tension as compared to another of said wales.

21. A candle wick as in claim 1, 10 or 15, which exhibits a wick curl when burned of no more than 90°.

22. A candle wick as in claim 1, 10 or 15, which exhibits a wick torque when burned of between about 45 degrees to about 135 degrees.

23. A candle wick as in claim 1, 10 or 15, which exhibits a wick rotation when burned of greater than about 45° per inch of burned candle length.

24. A candle wick as in claim 23, which establishes a wick rotation when burned of between about 90° to about 270° per inch of burned candle length.

25. A candle wick as in claim 1 or 15, wherein said at least one laid-in yarn has a tension sufficient to impart minimal stretch characteristics to the wick to achieve an axial elongation in wick length of less than about 15% when subjected to a tension force of 2 pounds as compared to an original wick length.

26. A candle having a knit candle wick, wherein said knit candle wick comprises:

a pair of parallel warp yarns knit into loops forming one and another adjacent wales, and at least one unknit laid-in yarn which is laid in and extends back and forth between the loops of said one and another wales to thereby join said one and another wales together, and wherein said at least one unknit laid-in yarn has a tension sufficient to impart minimal stretch characteristics to the wick to achieve an axial elongation in wick length of less than about 15% when subjected to a tension force of 2 pounds as compared to an original wick length.

27. A candle as in claim 26, wherein the candle wick exhibits a wick curl when burned of no more than 90°.

28. A candle as in claim 26, wherein the candle wick exhibits a wick torque when burned of between about 45 degrees to about 135 degrees.

29. A candle as in claim 26, wherein the candle wick exhibits a wick rotation when burned of greater than about 45° per inch of burned candle length.

30. A candle which includes a candle wick comprising at least one warp knit yarn end which is knit into interlocking loops in a warp-wise direction of the wick, and at least one laid-in yarn end which is weft-inserted into the loops of said warp-knit yarn end but oriented generally in a warp-wise direction of the wick.

31. A candle as in claim 30, wherein said at least one laid-in yarn has a tension that is at least substantially equal to or greater than the tension of said at least one warp knit yarn end.

32. A candle, which comprises a wick which includes a pair of parallel warp yarns knit into loops forming one and another adjacent wales, at least one and another warp-wise unknit laid-in yarns which are laid in the knit loops of said one and another said wales, respectively, and at least one additional unknit laid-in yarn which extends back and forth between the loops of said one and another wales to thereby join said one and another wales together.

33. A candle as in claim 30 or 32 wherein the wick is self-supporting.

34. A candle comprising a knit candle wick which includes a warp knit yarn end forming a series of interlocking loops, and at least one unknit yarn end laid in the loops and having a tension that is at least substantially equal to or greater than the tension of said warp knit yarn end sufficient to cause wick curl at a terminal end portion thereof upon burning.

35. A candle as in claim 34, wherein the candle wick exhibits a wick curl when burned of no more than 90°.

36. A candle as in claim 34, wherein the candle wick exhibits a wick torque when burned of between about 45 degrees to about 135 degrees.

37. A candle as in claim 34, wherein the candle wick exhibits a wick rotation when burned of greater than about 45° per inch of burned candle length.

38. A candle as in claim 37, wherein the wick exhibits a wick rotation when burned of between about 90° to about 270° per inch of burned candle length.

39. A candle as in claim 34, wherein the wick comprises a second unknit yarn end which is laid in the loops of said at least one warp knit yarn end differently than said at least one unknit yarn end.

40. A candle as in claim 39, wherein said second unknit yarn end is tensioned differently than said at least one warp knit and/or said at least one unknit yarn ends.

41. A candle as in claim 34, wherein the wick includes:

a pair of parallel warp yarns knit into loops forming one and another adjacent wales, at least one and another warp-wise unknit laid-in yarns which are laid in the knit loops of said one and another said wales, respectively, and at least one additional unknit laid-in yarn which extends back and forth between the loops of said one and another wales to thereby join said one and another wales together.

42. A candle as in claim 34, 35, 36, 39, 40 or 41, wherein the wick is self-supporting.

43. A candle as in claim 30 or 31, wherein said at least one laid-in yarn has a tension sufficient to impart minimal stretch characteristics to the wick to achieve an axial elongation in wick length of less than about 15% when subjected to a tension force of 2 pounds as compared to an original wick length.

44. A candle as in claim 34, wherein said at least one unknit yarn end has a tension sufficient to impart minimal stretch characteristics to the wick to achieve an axial elongation in wick length of less than about 15% when subjected to a tension force of 2 pounds as compared to an original wick length.

45. A candle wick comprising:

at least one warp knit yarn end forming a wale of interlocking loops, and at least one unknit laid-in yarn end of a different tension, size and/or material as compared to said at least one warp knit yarn end and which is laid in preselected ones of said interlocking loops to achieve a candle wick which exhibits at least one of:

(i) a wick curl when burned of no more than 90°, (ii) a wick torque when burned of between about 45° to about 135°, (iii) a wick rotation when burned of greater than about 45° per inch of burned candle length;

(iv) a self-supporting wick; and (v) an axial elongation in wick length of less than about 15% when subjected to a tension force of 2 pounds as compared to an original wick length.

46. A candle wick as in claim 45, which comprises a second unknit laid-in yarn which is laid in the interlocking loops of said at least one warp knit yarn end differently than said at least one unknit yarn end.

47. A candle wick as in claim 46, wherein the at least one warp knit yarn end is tensioned differently than said second unknit laid-in yarn end.

48. A candle wick as in claim 45, which comprises at least two differently tensioned unknit laid-in yarns and/or at least two differently tensioned warp knit yarn ends.

49. A candle as in claim 29, wherein the wick exhibits a wick rotation when burned of between about 90° to about 270° per inch of burned candle length.

* * * * *